US005165888A

United States Patent [19]

Rothschild et al.

[11] Patent Number: 5,165,888

[45] Date of Patent: Nov. 24, 1992

[54] GRAVITY FLOW THERMAL PROCESS FOR RECLAIMING FOUNDRY SAND

[76] Inventors: John J. Rothschild, 2883 Aspen La., Bloomfield Hills, Mich. 48013; James L. Donahue, 2294 Paulette, Walled Lake, Mich. 48088

[21] Appl. No.: 878,166

[22] Filed: May 4, 1992

Related U.S. Application Data

[62] Division of Ser. No. 476,813, Feb. 8, 1990, Pat. No. 5,110,288.

[51] Int. Cl.[5] ..... F27D 1/08

[52] U.S. Cl. ..... 432/14; 134/2; 432/96; 432/97; 432/99

[58] Field of Search ..... 432/95-101, 432/14; 134/2; 110/245, 101 CD

[56] References Cited

U.S. PATENT DOCUMENTS

| | | | |
|---|---|---|---|
| 3,033,545 | 5/1962 | Azbe | 432/99 |
| 3,142,480 | 7/1964 | Azbe | 432/99 |
| 3,356,351 | 12/1967 | Roberts et al. | 432/99 |
| 3,686,034 | 8/1972 | Rothschild . | |
| 3,822,657 | 7/1974 | Midkiff | 110/101 CD |
| 3,955,915 | 5/1976 | Buchner | 432/96 |
| 4,308,806 | 1/1982 | Uemura et al. | 110/245 |
| 4,334,859 | 6/1982 | Minegishi et al. | 432/97 |
| 4,598,670 | 7/1986 | Clamser et al. | 110/101 CD |
| 4,664,623 | 5/1987 | Sundermann et al. | 432/98 |
| 4,693,682 | 9/1987 | Lee et al. | 110/245 |
| 4,762,073 | 8/1988 | Giaier et al. | 110/101 CD |

OTHER PUBLICATIONS

"A Practical Guide to Selecting a Sand Reclamation System", Foundry, Mar., 1973, by John J. Rothschild.

"Sand Reclamation Can Be An Economical Answer to Solid Waste Disposal" Foundry, Apr., 1989, vol. 117, No. 4.

Brochure "Coreco" World Class Sand Reclaimers, 4 pages.

"Quipclaim" Thermal Sand Reclamation Brochure, Quiptec Inc., 4 pages.

GMD Engineered Systems, Inc. Brochure "Thermo-S-crubber" Sand Reclaimer 2 pages.

Advanced Sandsource Thermal Reclamation System, "CE CAST", Combustion Engineering, Inc. Brochure, 4 pages.

*Primary Examiner*—Henry C. Yuen

*Attorney, Agent, or Firm*—Harness, Dickey & Pierce

[57] ABSTRACT

A method and apparatus for thermally reclaiming used foundry sand is disclosed. The apparatus includes a vertically disposed furnace having a combustion chamber therein. A sand dispersion system supported within the combustion chamber disperses the free falling sand particles to expose the particles to a combustion supporting furnace environment. Disposed immediately below the furnace is a sand retention chamber in which the sand is accumulated. Heated air is introduced into the retention chamber to maintain the combustion supporting environment. Residual coatings remaining on the sand particles are thermally removed in the retention chamber.

5 Claims, 4 Drawing Sheets

GRAVITY FLOW THERMAL PROCESS FOR RECLAIMING FOUNDRY SAND

This is a division of U.S. patent application Ser. No. 07/476,813, filed Feb. 8, 1990, now U.S. Pat. No. 5,110,288.

BACKGROUND OF THE INVENTION

1. Field of the Invention

The present invention relates to the reclamation of used foundry sand and, more particularly, to a method and apparatus for generating improved removal and combustion of binder materials from used sand during reclamation processing.

2. Description of the Related Art

With the advent of stricter waste disposal standards in light of heightened environmental concerns, most foundries are currently faced with severe waste sand disposal problems. More specifically, many solid waste disposal sites have reached capacity while the cost of shipping waste (i.e. used) sand to operating disposal sites has grown substantially. Likewise, on-sight disposal is generally not a viable alternative in view of the promulgation of environmental protection regulations and because most foundries lack adequate space. To this end, reclamation of used sand, which would otherwise have to be discarded, permits a foundry to operate more efficiently and cost effectively. Reclamation of sand for reuse in certain foundry operations, however, is often complicated by the presence of a non-regenerative or non-reusable carbonaceous coating formed on the used sand which must be removed before the sand may be reused. For example, many foundry operations use synthetic resin binders which are added to the sand prior to forming cores and molds. These binders form a coating on the individual sand grains to bind them together with sufficient strength to resist pressure from the molten metal until it solidifies. As is known to those skilled in the art, these coatings should be eliminated before the sand can be effectively reused in foundries for mold and core making. Other foundries use binderless sand for mold making in conjunction with the "lost foam" evaporative casting method. During the molten metal pouring cycle, the polystyrene plastic patterns vaporize with a portion of these vapors condensing on contact with the sand particles making the sand tacky after repeated use. Again, the used sand has to be either discarded or the tacky coating must be removed.

In order to reuse the sand, it is necessary for the sand to be thermally treated to "burn-off" or "incinerate" any carbonaceous coating remaining on the sand grains which was not eliminated during the casting operation. The terms "burn-off" and "incinerate" refer to the normal combustion process and to the process of removing non-combustible constituents through evaporation. Thermal sand reclamation processing must consistently remove a specified minimum percentage of the binder material or coating before the sand can be effectively reused.

Several thermal sand reclamation systems functioning to "burn-off" coatings from the sand grains are known in the art. One type involves metering a generally horizontal bed ("fluidized bed") of sand through a furnace and exposing the sand bed to a high temperature, oxygen-rich combustion environment to burn off the carbonaceous coating. The horizontal sand bed is agitated ("fluidized") by a turbulent air updraft to provide increased exposure of the sand grains to the combustion environment. Therefore, energy in the form of heated and sufficiently pressurized air is required to turbulently fluidize the sand bed. Likewise, it is known that most prior art systems require relatively long sand retention times in the combustion zone to achieve adequate combustion of the carbonaceous coating. Extended sand retention time results in a relatively low system efficiency. A second type of sand reclamation system includes a stacked columnar fluidized bed wherein a vertical column of sand is maintained and heated along its length to burn-off the carbonaceous coating. A third type of reclamation system includes a horizontal rotary kiln (calciner) having a refractory lined cylindrical vessel which is associated with a burner unit for heating the kiln to a temperature of up to about 2,000° F. The sand is tumbled through the kiln because of the rotary motion to expose the sand to the combustion environment.

The sand reclamation system identified in U.S. Pat. No. 3,686,034, having a common inventor with the present invention, discloses a gravity flow, thermal reclamation process which is substantially free flowing and which provides a dispersion of sand particles as they pass downwardly through a vertical furnace. The gravity fed sand passes sequentially through a series of transversely displaced sand dispersion diffusers (grates) mounted within the open zones of the furnace. The orientation of the free falling sand particles is continuously varied along the length of the furnace between the vertical planes of adjacent diffusers such that substantially the entire surface of each sand particle is exposed to the high temperature oxygen-rich incinerating combustion environment. As such, rapid removal and subsequent combustion of particulate coatings is achieved.

The "prior art" thermal reclamation systems herebefore described are adapted to remove a substantial portion of the binder material coatings deposited on the sand grains. However, the present invention is an improvement over "prior art" systems in that residual coatings remaining on the sand grains can be thermally removed. In this manner, the reclaimed sand is of a higher quality and can be more effectively reused in foundry operations.

SUMMARY OF THE INVENTION

Accordingly, a principle object of the present invention is to provide an improved method and apparatus for continuously recovering (reclaiming) used foundry sand which includes a substantially free flowing, downwardly gravitating dispersion of sand particles passing through a vertically disposed furnace which terminates in a heated retention chamber. The retention chamber provides additional dwell time to permit substantially complete combustion of any residual particulate or carbonaceous coating.

Another object of the present invention is to provide a highly efficient, low cost, continuous, thermal sand reclamation system wherein binder materials and other coatings formed on the sand grains undergo substantially complete removal and combustion within a relatively short retention time.

A further object of the present invention is to provide an improved "hold-up" cascading grid design for use in the gravity flow, thermal sand reclamation furnace apparatus. Furthermore, the heated retention chamber is provided at the lower end portion of the vertical combustion chamber and is equipped with a permeable liner material which permits heated air to ventilate the sand grains to remove any residual carbonaceous coating remaining thereon.

Additionally, it is another object of the present invention to provide an apparatus which incorporates temperature control zones for providing improved fuel economy through improved heat transfer effectiveness. Likewise, the present invention includes sand level and flow gating systems for selectively controlling the discharge of reclaimed sand from the retention chamber.

These objects and others are achieved by an improved process for thermally reclaiming used foundry sand wherein the used sand is gravity fed as a substantially free flowing, downward dispersion of sand particles through a vertically disposed furnace. The furnace defines a combustion chamber having a sand dispersion system positioned therein comprised of a series of grids or sand diffusers with open zones defined therebetween such that the free falling sand sequentially strikes the grids of the dispersion system. In this manner, the sand is further dispersed and thereby exposed to a combustion supporting environment in the open zones. The sand dispersion is initially exposed to the combustion supporting furnace environment in each open zone which results in removal through combustion of a large percentage of any particulate or sand grain coating. Thereafter, the hot reclaimed sand particles are accumulated in the retention chamber where the sand is then further exposed to a maintained combustion supporting environment. Specifically, heated air is introduced into the retention chamber through a permeable plenum wall surface to permit complete evaporative removal and combustion of any residual binder materials remaining on the sand.

Compared to the previously disclosed "prior art" methods, the present invention can be used for short time runs as well as operated intermittently such that the sand flow can be started and stopped at will. Most "prior art" systems require an expensive power backup system to avoid "coking" of the sand in case of a power failure. In the described apparatus, the bottom gate control can be controllably opened to drain the hot sand out of the retention chamber to avoid "coking" during a power failure. Therefore, no backup system is required which is a significant improvement over prior art systems.

BRIEF DESCRIPTION OF THE DRAWINGS

Various other objects and advantages of the present invention will become apparent to one skilled in the art upon reading the following detailed description and by reference to the following drawings in which.

DESCRIPTION OF THE PREFERRED EMBODIMENTS

Figure 1:
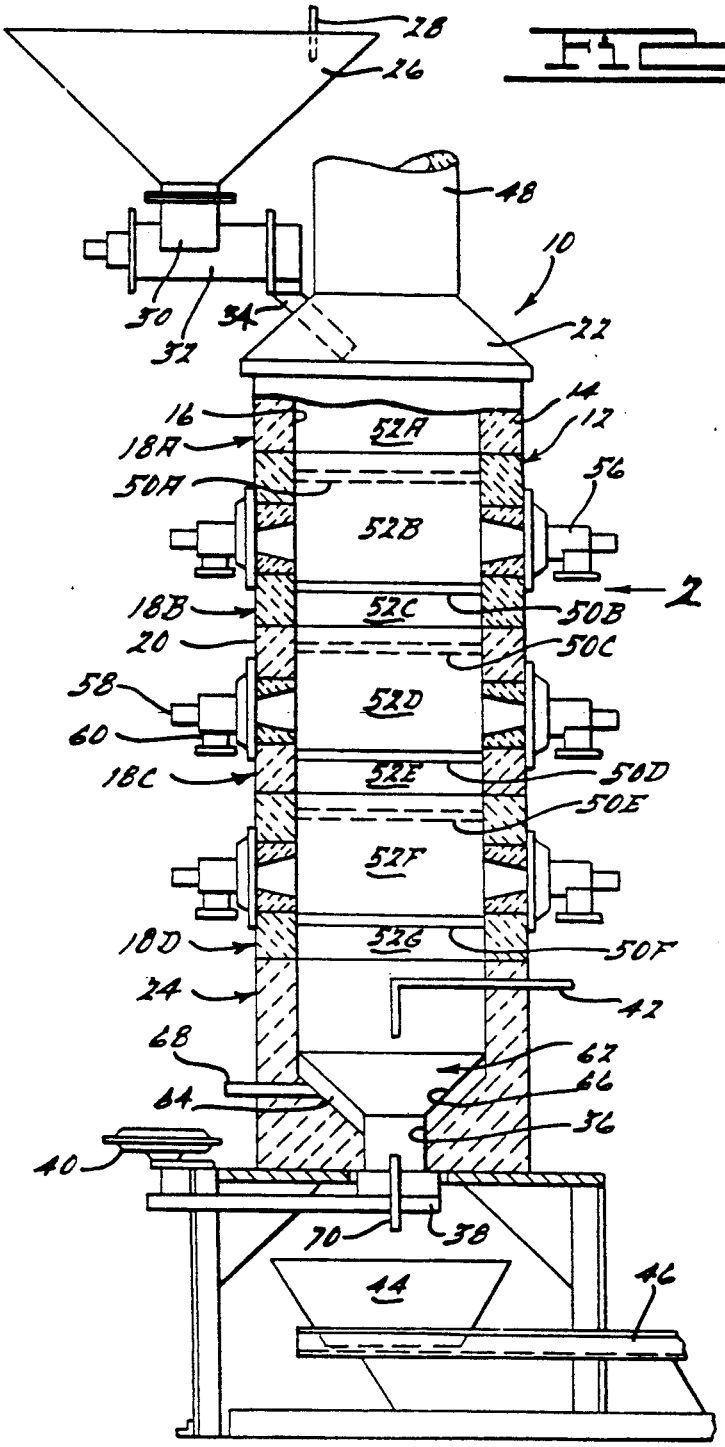
FIG. 1 is a cross-sectional view of the improved gravity flow sand reclamation furnace equipped with a sand retention chamber.
Figure 2:
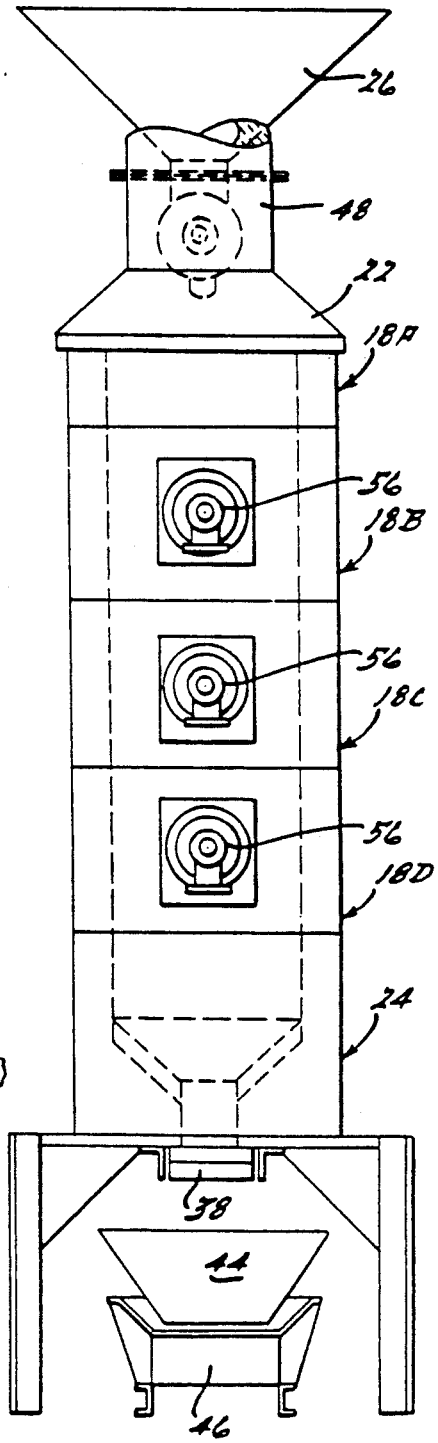
FIG. 2 is a side view taken in the direction of arrow 2 of FIG. 1.

Referring now to FIGS. 1 and 2, a gravity flow, thermal sand reclamation apparatus 10 in accordance with a first preferred embodiment is illustrated. Apparatus 10 is comprised of an elongated vertically disposed furnace 12 which preferably is fabricated to have a square or rectangular cross-section. Heat resistant refractory side wall surfaces 14 define a confined combustion chamber 16 within furnace 12. More preferably, furnace 12 is composed of a plurality of furnace portions 18A through 18D which are configured to be sealingly mounted in vertical adjacent orientation to define a desired furnace length as will be hereinafter detailed. Outer wall 20 of furnace 12 is preferably fabricated from a strong, structurally supportive material, such as steel, which surroundingly encapsulates refractory side wall surfaces 14. Combustion chamber 16 is enclosed by a top member 22 and a lower accumulation hopper portion 24 to be hereinafter described in greater detail.

Provided generally above or parallel with top member 22 is surge hopper 26 which is filled with the waste (i.e. used) sand which is to be reclaimed. Surge hopper 26 includes a level control sensor 28 which is employed to maintain surge hopper 26 in a relatively full status. High and low level control sensor 28 may include any level sensing device or system known in the industry. Likewise, it is contemplated that surge hopper 26 can be fed with used sand either automatically or manually according to means known in the art.

Surge hopper 26 includes a lower central opening portion 30 which feeds the used sand onto a variable speed screw conveyor 32. The speed of conveyor 32 selectively controls the flow rate of used sand into combustion chamber 16 via chute 34 provided at the discharge end of conveyor 32. It is contemplated that the present invention may include the use of a controller device to selectively control the speed (flow rate) of conveyor 32. When filled with sand, surge hopper 26 acts as a airlock between combustion chamber 16 and the ambient atmosphere. As illustrated in FIGS. 1 and 2, portion 18A defines the uppermost portion of combustion chamber 16 and is securely mounted to top member 22.

Below the accumulating hopper section 24 is an outlet opening 36 of a predetermined cross-section which is held normally closed by a discharge gate 38. At predetermined continuous intervals, discharge gate 38 is proportionately opened through actuation of a discharge gate operator 40 which can be controlled by the furnace controller (not shown). More specifically, as the sand material enters and accumulates in accumulating hopper section 24, a portion of pneumatic level sensing device 42 is covered, thus signalling the controller to activate discharge gate operator 40 to proportionately open discharge gate 38 to maintain a fixed sand level in accumulating hopper section 24. Likewise, as sand is discharged through outlet opening 36, sensing tube 42 is uncovered which signals the controller to proportionately close discharge gate 38. The sand in accumulation hopper section 24 and within discharge opening 36 seals the combustion chamber 16 from undesirable end drafts. Upon completion of the reclamation process, the sand particles are discharged into hopper 44 which is movably disposed on conveyor 46. It is to be understood that any means known in the industry for receiving and transporting the discharged sand following reclamation is within the scope of the present invention.

Positioned above furnace 12 and integral with top member 22 is exhaust ventilation duct 48 which communicates with combustion chamber 16 to remove any effluent gases resulting from combustion of the particulate and carbonaceous coatings. Likewise, duct 48 is adapted to exhaust the products of combustion generated by the burners. A portion of the thermal energy liberated upon combustion in the form of increased heat in the effluent gases is exhausted therethrough. It is contemplated that recuperative means for recovering heat exiting through duct 48 can be employed as required in specific applications to increase the overall system efficiency and fuel economy. Likewise, the present invention may be equipped with an after-burner unit as required to eliminate any byproducts of the combustion process.

Figure 3:
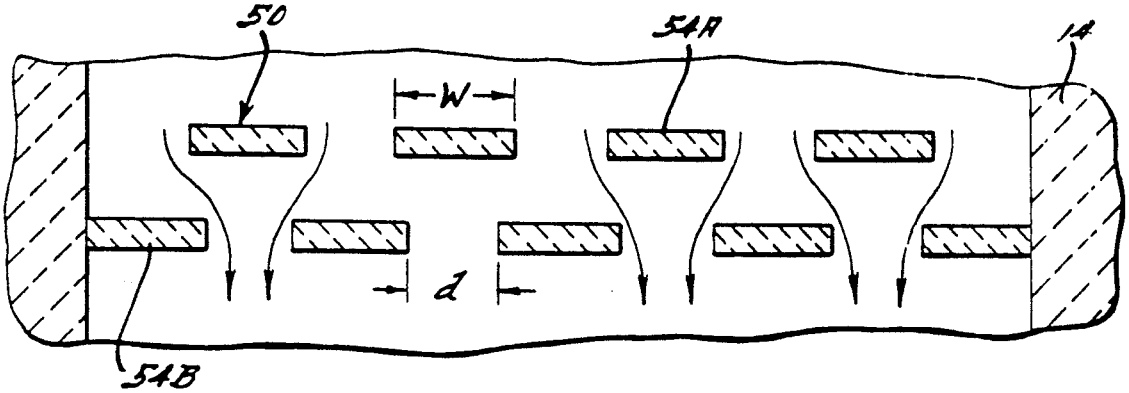
FIG. 3 is an enlarged cross-sectional view of a hold-up cascading grid pattern incorporated into the furnace of FIG. 1.

Mounted within and across combustion chamber 16 in generally orthogonal orientation to the longitudinal axis of furnace 12 are a plurality of sand dispersion grids 50 spaced longitudinally from one another along the length of combustion chamber 16 and which define a series of open zones 52 intermediate thereof. Used sand is fed into combustion chamber 16 via chute 34 of screw conveyor 32 and impacts against a first dispersion grid 50A in a manner such that the sand is spread over substantially the entire cross-section of combustion chamber 16. Due to gravity, the used sand material cascades from grid to grid, 50A through 50F, respectively, within combustion chamber 16 with the fall velocity of the sand being reduced to substantially zero as the material impacts against each adjacent lower dispersion grid. More particularly, as can be seen in reference to FIGS. 3 and 4, each dispersion grid 50 defines at least two parallel sets of grid members 54A and 54B which are provided in relatively close longitudinal relation. The grid members 54A and 54B are evenly spaced across the entire width of combustion chamber 16. The first set of grid members 54A is offset relative to the second set 54B to produce an "over-lapping" effect. More particularly, the spacing "d" between adjacent grid members 54A is less than the width "w" of each grid member. As such, the dispersion grids 50 act to "hold-up" the cascading sand particles thereby exposing the sand for a longer period of time within each open zone 52.

Figure 4:
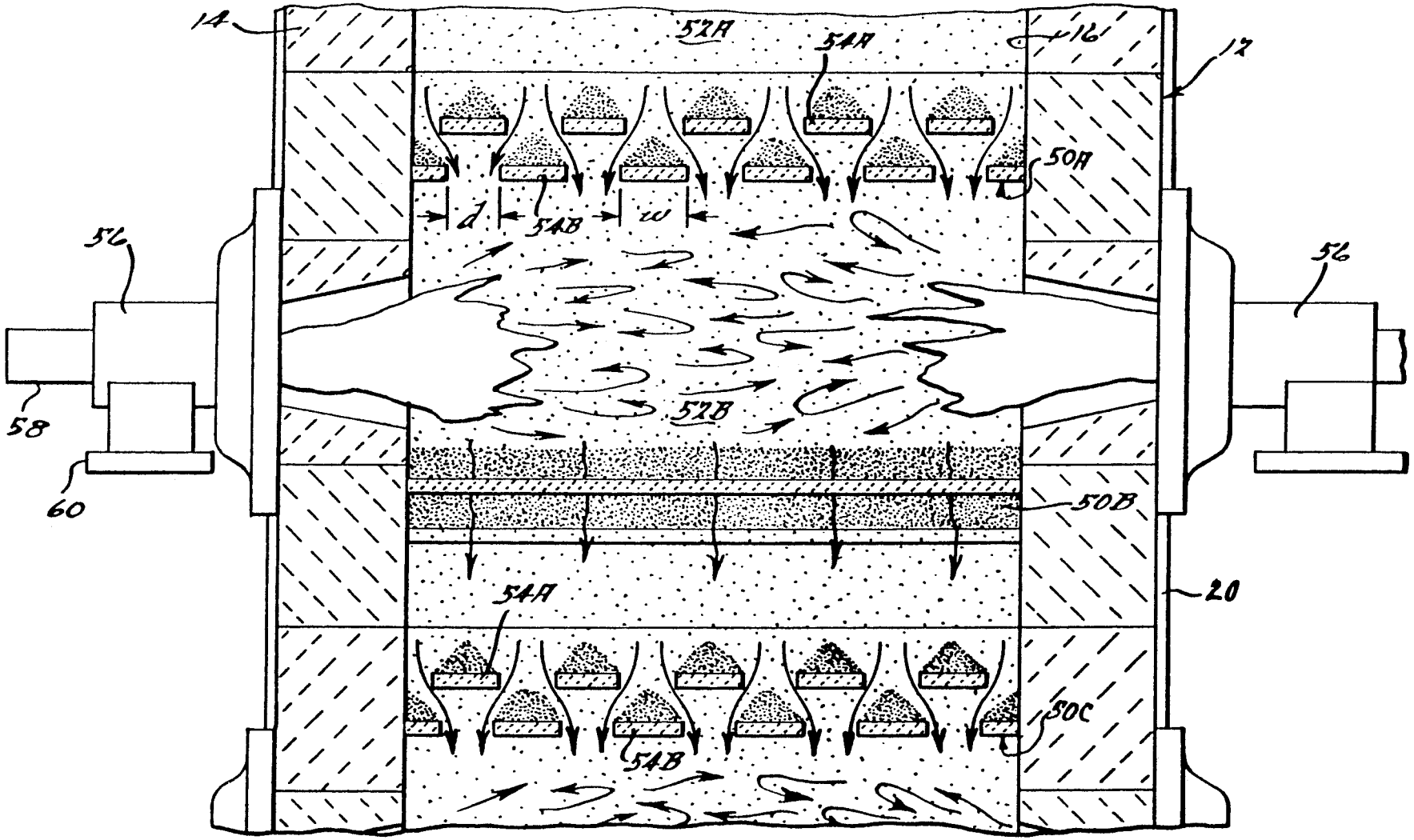
FIG. 4 is a cross-sectional view of a plurality of hold-up cascading grids illustrating the free-falling dispersion pattern of the sand.

In the preferred embodiment shown in FIG. 4, alternating dispersion grids 50A through 50C are generally longitudinally disposed along the longitudinal axis of furnace 12 and are oriented in orthogonal relation to the next adjacent grid. Therefore, each dispersion grid is orthogonally orientated relative to its adjacent grid (i.e., 50A relative to 50B) with all the dispersion grids being mutually orthogonal to the longitudinal axis of furnace 12. Dispersion grids 50 function to further disperse the sand particles as they pass through chamber 16 sequentially onto the next lower dispersion grid thereby continuously changing the orientation of the sand particles as they cascade down the length of furnace 12.

Extending through opposing side walls 14 and outer wall 20 of furnace 12 and located intermediate cascading grids 50A through 50F are a plurality of torch heating burners 56 mounted so as to direct flames and heated air toward the center of combustion chamber 16 and across the open zones 52. As illustrated in FIG. 4, the torch burners 56 generate a highly turbulent environment within open zones 52 so as to further disperse the sand particles therein. Sand particles are exposed to convection heat transfer from direct contact (impingement) with the flames and from radiant heat transfer from the refractory side walls 14. More preferably, burners 56 are localized gas heating devices having variable temperature control characteristics and the capability of providing a volume of air in excess of that needed to maintain combustion. Connected to burners 56 is an air source 58 and a fuel (i.e. natural gas) source 60. Burners 56 are designed to operate under excess air conditions to provide an oxygen-rich furnace environment to assure complete, substantially instantaneous combustion of any undesirable sand coatings. As such, furnace 12 is designed to operate under an oxidizing mode of operation. While burners 56 are illustrated in oppositely aligned orientation, it is contemplated that an offset orientation can be employed to provide increased turbulence.

Figure 5:
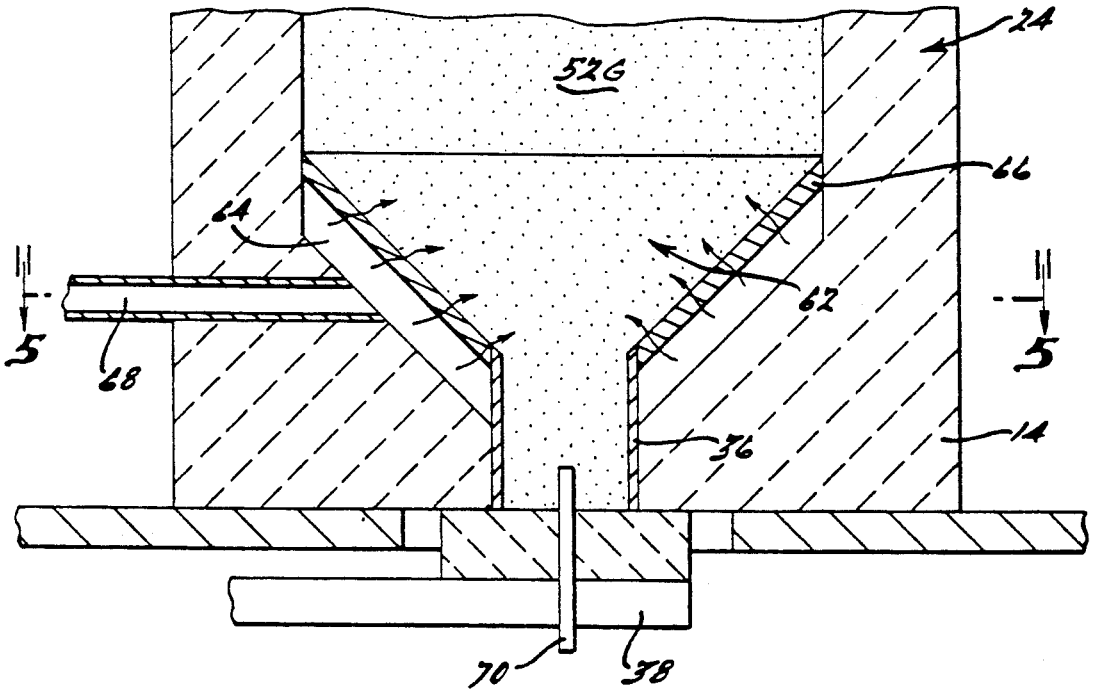
FIG. 5 is an enlarged view of the heated sand retention chamber.
Figure 6:
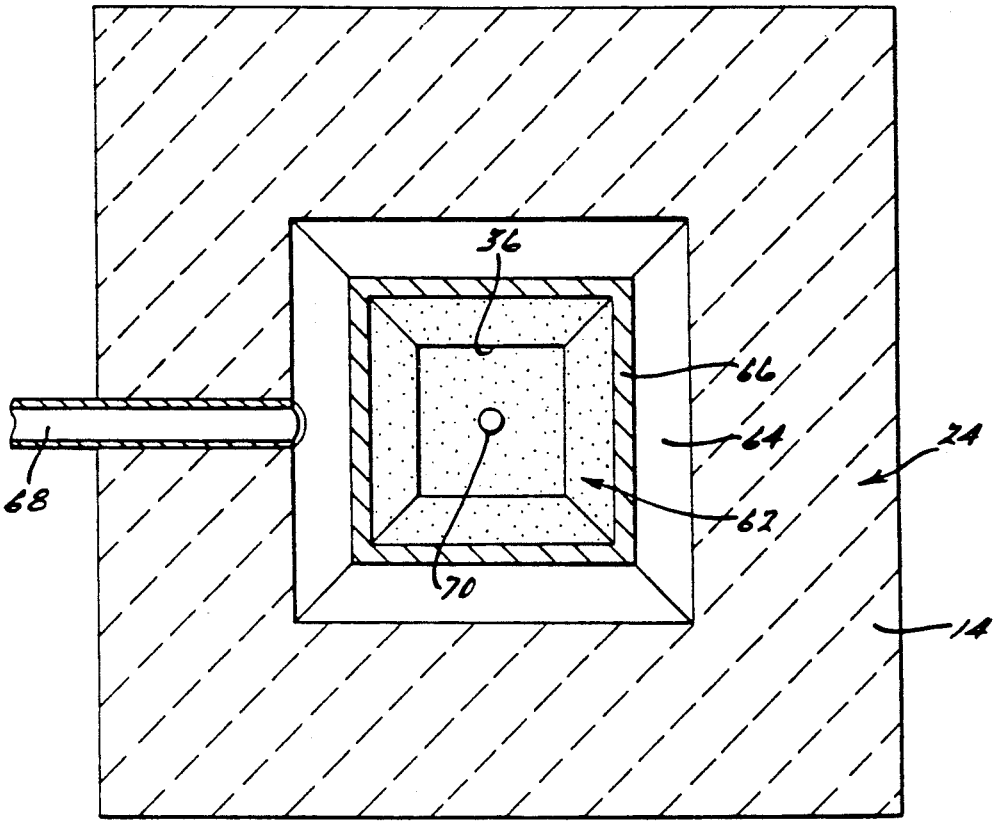
FIG. 6 is a cross-sectional view taken along line 5—5 of FIG. 5.

To assist in completely removing any "residual" coating remaining on the sand, heated air is introduced into the sand maintained in retention well 62 of accumulating hopper section 24. The sand in retention well 62 is not cooled, but is maintained at an elevated temperature condition to promote additional combustion. More particularly, as is seen in greater detail in FIGS. 5 and 6, retention well 62 is preferably provided as a separate structural component upon which furnace sections (such as 18D) are mounted. Retention well 62 provides additional dwell time for the sand at a predetermined increased temperature to provide a more complete "incineration" of contaminants and residual carbonaceous byproducts. The retention well 62 includes a plenum chamber 64 supporting a permeable (porous) wall member 66 therein. Wall member 66 is configured as a hopper-type structure which terminates at discharge outlet 36. Various sintered permeable metals or laminates defining a monolithic porous surface are the preferred materials of choice for porous wall member 66. Such materials provide uniform pore or slot size, easy cleaning and maintenance for long life in the furnace environment. The pore or slot size is selected to permit heated air to communicate with sand which has accumulated in retention well 62 without permitting the sand to pass through wall member 66. Alternatively, a shingled or overlapping louver type chamber structure may be used for permitting introduction of air therein while inhibiting the passage of sand particles therethrough. However, it is to be understood that any material or system which provides the requisite permeability, heat resistance and strength is within the scope of this invention.

Heated air is introduced into the hot sand material resting on the inner surface of porous wall member 66 through line 68. More specifically, heated air which is introduced via line 68, to fill plenum chamber 64, passes through the pores of wall member 66 to remove any "residual" vapors and to incinerate any binder material or carbonaceous coating remaining on the sand grains. In this manner, improved overall removal of contaminates is provided. Air provided at a preselected elevated temperature and pressure penetrates (i.e. ventilates) the sand thereby allowing sufficient oxygen to pass between the granular sand particles to permit additional combustion and to carry away the byproducts of combustion up through furnace 12. More specifically, the heated air maintains the sand at the desired temperature to provide the additional dwell time such that the heated air removes any residual vapors that are trapped in the interstices of the sand particles and thereby complete the combustion process. Preferably, the heated air will be non-fluidizing since turbulence within chamber 64 is not required. However, the desired air pressure will be determined by the combustion parameters of the specific material to be thermally eliminated. A thermocouple 70 is provided to sense the temperature of the sand within the retention well 62. A second thermocouple (not shown) may also be used to sense the temperature of the air immediately above the sand accumulated in retention well 62. A signal generated from these thermocouples is utilized by the furnace controller to regulate the combustion supporting atmosphere provided by burners 56 within combustion chamber 16 thereby delivering the sand to chamber 64 at the desired temperature. More preferably, apparatus 10 includes separate temperature controlled zones defined by the various open zones 52 which are monitored and controlled by the furnace controller to provide improved fuel economy. Specifically, it is contemplated that different temperature zones may be defined at each of the longitudinally open zones 56 within furnace 12 to accommodate for natural heat transfer upward through combustion chamber 16 from plenum chamber 64 and the lowermost open zones 52.

During operation of the present invention, used mold or core sand is first crushed and then screened as needed to form a free flowing sand mixture. The sand is then fed into furnace 12 through conveyor 32 and chute 34. The speed of conveyor 32 may be varied to maximize the furnace capacity for a given heat input. As the sand is fed into furnace 12, it falls under the force of gravity in the form of a substantially free-flowing, downwardly gravitating dispersion of sand particles through the first open zone 52A where it is immediately exposed to radiant heat. The free falling sand dispersion then strikes dispersion grid 50A wherein the dispersion is further dispersed as it falls through grid members 54A and 54B and turbulently cascades through the adjacent open zone 52B and then onto the next lower dispersion grid 50B. As the sand falls through open zone 52B, it is again subjected to radiant heating and to convection heating from direct flame impingement. Thereafter, the sand continues to fall from the upper dispersion grids to the next lower dispersion grids, 50B through 50F, thereby being continuously further dispersed through intermediate open zones 52. In each open zone the sand dispersion is subjected to radiant heat emanating from the side walls 14 and convection heat from direct impingement with flames from torch burners 56. In this manner the orientation of the sand particles is continuously changed in a relatively turbulent manner along the entire length of furnace 12, whereby substantially the entire surface of each sand grain is exposed to radiant and convection heat and a combustion supporting atmosphere in at least one of the open zones.

Burners 56 direct heat into the open zones and are controllably operated to provide and maintain the preselected sand temperature within each open zone.

After passing through combustion chamber 16, the treated sand falls into retention well 62 and accumulates against the inner surface of wall member 66. Heated air, preferably at the final desired sand temperature, is presented via line 68 into plenum chamber 64 and permeates through wall member 66 to "ventilate" the sand accumulated in well 62. In this manner, additional dwell time for supplemental removal of vaporized constituents through the combustion process is provided.

The temperature of the sand exiting furnace 12 through discharge outlet 36 is controlled so as to be discharged at a desired temperature. At the completion of the thermal reclamation process the sand has a grain distribution equal to that of new sand. Thus it will be seen that the present invention provides an improved process for thermally reclaiming used foundry sand achieving substantially complete removal of various binder materials with short sand retention times in combustion chamber 16 and retention chamber 62. Accordingly, it is apparent that a furnace built in accordance with this invention will have a vertical combustion chamber with a height and cross-section defined by the tonnage per hour of sand which must be processed to attain the substantially complete removal of the grain coating. Additional furnace sections 18 can be readily utilized to meet the specific requirements of apparatus 10 under various operating applications.

Figure 7:
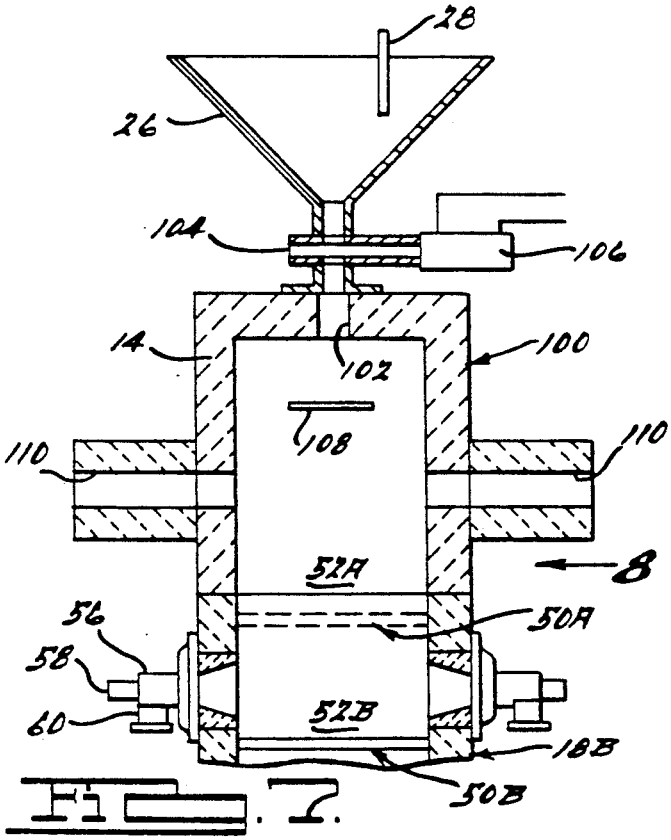
FIG. 7 is a cross-sectional view of the upper portion of a second embodiment of the vertical gravity flow sand reclamation furnace of the present invention.
Figure 8:
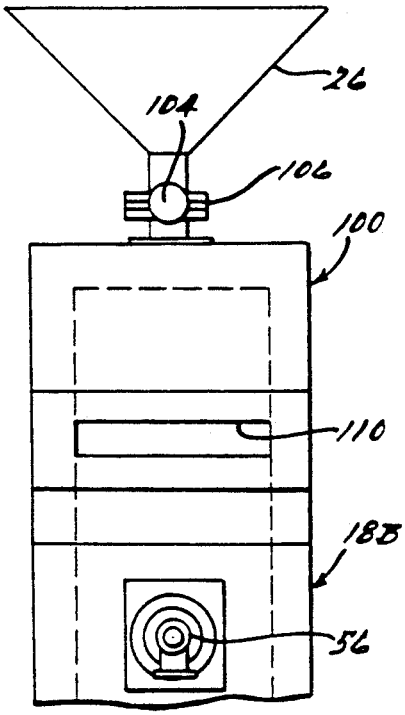
FIG. 8 is a side view taken in the direction of arrow 8 of FIG. 7.

An upper portion of a second preferred embodiment of the present invention is illustrated in reference to FIGS. 7 and 8. Like reference numerals are used to describe like structural components which have previously been described. Specifically, a surge hopper 26 is mounted centrally over a modified top portion 100 having a central opening 102. In general, the second embodiment encompasses an apparatus having a top loading configuration with side exhaust ducts integral with top portion 100. Again, surge hopper 26 is maintained in a generally full condition via level control sensor 28. A pneumatically operated slide gate 104 with adjustable stops 106 controls the material flow rate into combustion chamber 16. A target plate 108 disposed immediately below central opening 102 is provided to initially disperse the sand particles across the entire cross-section of combustion chamber 16. Between inlet opening 102 and dispersion grid 50A are exhaust vents 110 which remove the effluent gases resulting from the combustion of the carbonaceous coating.

The present invention has been described in an illustrative manner. It is to be understood that the terminology used is intended to be in the nature of words of description rather than of limitation. Many modifications and variations of the present invention are possible in light of the above teachings. It is contemplated that the subject invention can be utilized for any other granulated material and/or for pre-heating or drying granulated material through controlled regulation of the desired temperature. Therefore, within the scope of the appended claims, the present invention may be practiced otherwise than as specifically described.

What is claimed is:

1. A method for removing a coating from used foundry sand, said method comprising the steps of:

providing a generally vertically disposed furnace defining a combustion chamber therein and having sand dispersion means extending across said combustion chamber for dispersing said used sand within said combustion chamber and defining a plurality of open zones;

feeding a quantity of used sand into an upper portion of said combustion chamber in the form of a substantially free-flowing downward dispersion of used sand particles;

generating a combustion supporting atmosphere in each of said open zones whereby said coating undergoes substantially instantaneous combustion;

accumulating said free falling sand particles exiting from said combustion chamber in an accumulating hopper section disposed immediately below a lower end of said furnace, said accumulating hopper section having a permeable wall structure;

introducing air at a preselected temperature and pressure through said permeable wall structure and into said accumulated sand particles in said accumulating section to maintain said combustion supporting atmosphere thereby permitting supplemental combustion of residual coating remaining on said sand particles; and discharging said reclaimed sand particles from said accumulating section.

2. The method of claim 1 further comprising the step of permitting said sand particles to fall freely through said combustion chamber to sequentially strike and pass through said sand dispersion means, said sand particles being generally turbulently dispersed thereby exposing each sand particle to a combustion supporting atmosphere in at least one of said open zones.

3. The method of claim 2 further comprising the step of providing a furnace controller means for monitoring and controlling said combustion supporting atmosphere within each of said open zones.

4. The method of claim 3 wherein said feeding step comprises providing a surge hopper and a flow metering device associated therewith for metering the quantity of used sand delivered to said combustion chamber.

5. The method of claim 1 wherein said step of introducing heated air through said permeable wall structure and into said accumulated sand particles acts to maintain said combustion supporting atmosphere at a predetermined temperature for a predetermined amount of time in said accumulating section.

* * * * *